US005417644A

United States Patent [19]

Lee

[11] Patent Number: 5,417,644

[45] Date of Patent: May 23, 1995

[54] RECIPROCATING MASSAGE APPARATUS

[76] Inventor: Ming L. Lee, No. 31, Lung Hua Road, Lung-Tan Tsun, Lung-Tan Hsiang, Taoyuan Hsien, Taiwan, Prov. of China

[21] Appl. No.: 160,676

[22] Filed: Dec. 2, 1993

[51] Int. Cl.[6] ..... A61H 1/02

[52] U.S. Cl. ..... 601/98; 601/29; 601/101; 601/104; 74/55

[58] Field of Search ..... 601/97–106, 601/107–111, 27, 28, 29; 74/55

[56] References Cited

U.S. PATENT DOCUMENTS

| | | | |
|---|---|---|---|
| 1,339,179 | 5/1920 | Elmen | 601/97 |
| 3,109,177 | 9/1961 | Grafmyer | 128/51 |
| 4,711,229 | 12/1987 | Hengl | 128/52 |
| 5,107,822 | 4/1992 | Ohashi | 128/52 |
| 5,215,078 | 6/1993 | Fulop | 128/52 |

FOREIGN PATENT DOCUMENTS

| | | | |
|---|---|---|---|
| 710537 | 8/1931 | France | 601/101 |
| 2269106 | 2/1994 | United Kingdom | 601/134 |

*Primary Examiner*—Robert A. Hafer
*Assistant Examiner*—David J. Kenealy
*Attorney, Agent, or Firm*—Bacon & Thomas

[57] ABSTRACT

A massage apparatus for massaging ankles or calves by means of reciprocating movement, comprising driving means which drives a bearing seat and a bearing fixed thereto to eccentrically rotate; the bearing being closely fitted in a slant guide area disposed in front of a self-lubricating sliding member which is pushed to reciprocate in lateral directions along a set of shafts when the bearing is driven by the driving means to eccentrically rotate and generates a horizontal component applying on the wall of the slant guide area; and a rest member for supporting a user's ankles or calves being connected to top end of the sliding member is thereby do lateral reciprocating movement to provide the chiropractic and massage effect on the user's ankles or calves.

3 Claims, 4 Drawing Sheets

RECIPROCATING MASSAGE APPARATUS

BACKGROUND OF THE INVENTION

1. Field of the Invention

The present invention relates to a massage apparatus, and more particularly to a massage apparatus suitable for massaging the user's ankles or calves via reciprocating movement.

2. Description of the Prior Art

There is a type of massage apparatus for massaging the user's legs via laterally reciprocating movement being commercially available. Such conventional leg massage apparatus mainly includes an electric motor and a reducing mechanism to drive an eccentric shaft to rotate. The eccentric shaft is fixedly provided at its free end a wheel which is inserted into an elongated through slot of a slide block. The rotary movement of the eccentric shaft drives the slide block to swing right and left along a slide shaft. The laterally swinging slide block is fixedly connected at its top end to a massage rest for the user to rest his or her ankles or calves thereon. In such conventional massage apparatus, the eccentrically rotating wheel contacts the peripheral wall of the elongated through slot of the linearly moving slide block and produces a considerable frictional resistance and impact force against the slide block which in turn causes damage to the massage apparatus due to over wearing of the wheel and the slide block, high dB noise during the operation of mechanisms, as well as poor transmission efficiency that requires the use of motor of higher power.

It is therefore desirable to develop a massage apparatus which eliminates the above-mentioned disadvantages existing in the conventional massage apparatus.

SUMMARY OF THE INVENTION

It is a primary object of the present invention to provide a massage apparatus which has higher transmission efficiency and restrains the production of noise during operation.

Another object of the present invention is to provide the above described massage apparatus which has simplified structure and is practical in use while it can be manufactured at lower cost.

A further object of the present invention is to provide the above described massage apparatus of which the elements has reduced friction and impact force between them, therefore, damage caused by over wearing of elements can be avoided and the life of apparatus can be extended. Moreover, the apparatus can operate silently.

The massage apparatus possessing the aforesaid advantages is powered by an electric motor and a reducing gear set, and has driving means having a driving shaft, a bearing seat and a bearing fixed thereon, being eccentrically fixed to the driving shaft, and a sliding member made of self-lubricating material. The sliding member makes laterally reciprocating movement along a set of shafts. To the top of the sliding member, a curved rest member is fixedly attached for a user to put his or her ankles or calves thereon. The self-lubricating sliding member has a slant guide member attached thereto and the bearing is closely fitted inside the guide member. When the bearing is driven by the driving means to eccentrically rotate, the horizontal component applying on the walls of the slant guide member pushes the sliding member and accordingly the curved rest member fixed to the top of the sliding member to laterally reciprocate along the set of shafts, and therefore, generating a chiropractic and massage effect on the user's ankles or calves.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
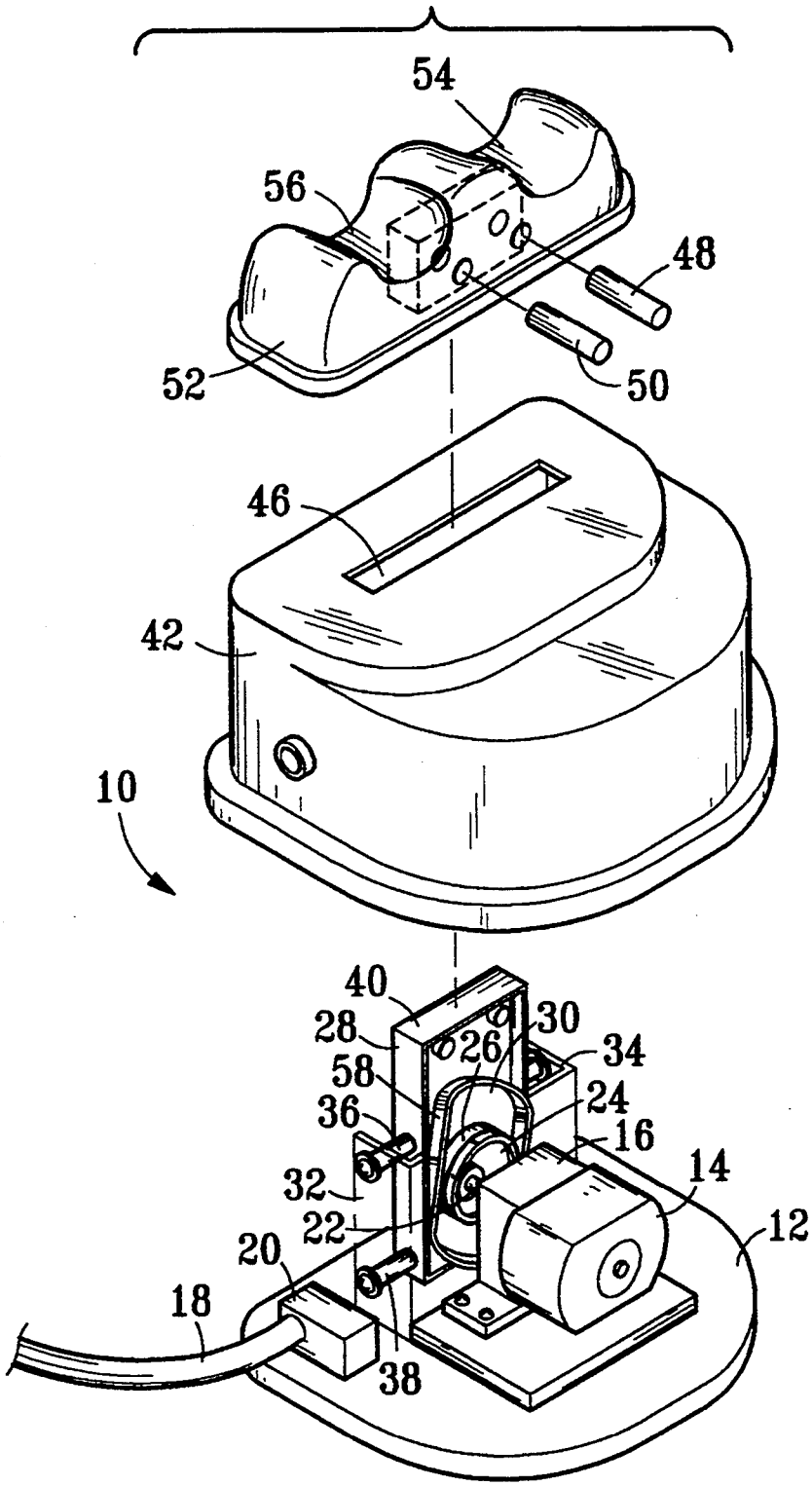
FIG. 1 is an exploded perspective of the massage apparatus according to the present invention.
Figure 2:
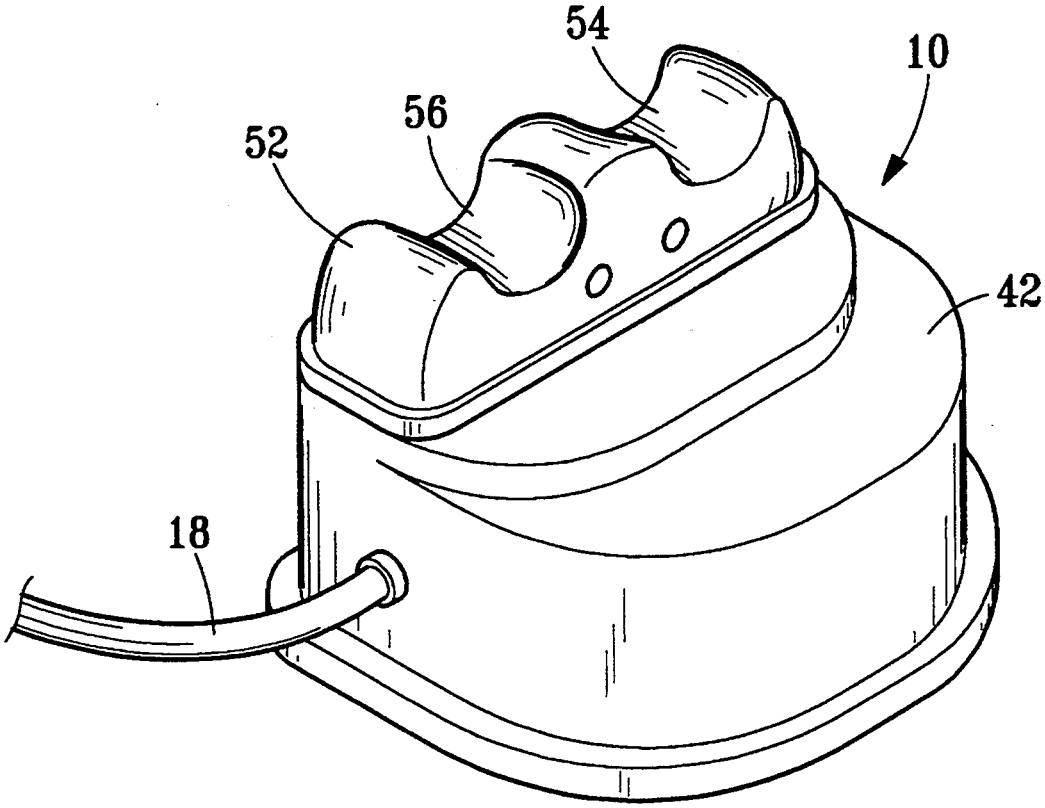
FIG. 2 is an assembled perspective of the massage apparatus shown by FIG. 1.

Please refer to FIGS. 1 and 2 at the same time. A massage apparatus 10 according to the present invention mainly has a base 12, an electric motor 14 and a reducing gear set 16 thereof fixed to the base 12, a set of power feeder 18 and a control circuit 20, a driving shaft 22 being driven by the motor 14 and reduced to a lower rotational speed by the reducing gear set 16, a bearing seat 24 and a bearing 26 fixed thereto, being eccentrically connected to the driving shaft 22, a sliding member 28 made of self-lubricating material, such as Teflon, a slant guide area 30 defined by a circle of slant flange 58 and locating at a front face of the self-lubricating sliding member 28, a set of horizontal shafts 36, 38 extending through the sliding member 28 and being locked at two ends to two lateral fixing plates 32, 34 separately, a housing 42 having a top slot 46 through where a top end 40 of the sliding member 28 extends and connects a rest member 52 by means of fixing pins 48, 50.

The circle of slant flange 58 has two parallel straight lateral sides and two curved end edges. The radian of the two curved end edges of flange 58 is substantially the same as that of the bearing 26, and the transverse width between the two parallel straight lateral sides of the flange 58 equals to the outer diameter of the bearing 26, such that the bearing 26 is closely fitted inside the slant guide area 30.

Being transversely extended through by the set of horizontal shafts 36, 38, the sliding member 28 is limited to make only linear reciprocating movement in lateral directions.

The rest member 52 is formed with a pair of curved recesses 54, 56 for a user to rest his or her ankles or calves thereon.

Please now refer to FIGS. 3A, 3B, 4A, and 4B. When the bearing 26 eccentrically rotates inside the slant guide area 30, it drives the sliding member 28 and accordingly the rest member 52 fixed to the top of the sliding member 28 to make horizontal reciprocating movement in lateral directions.

Figure 3A:
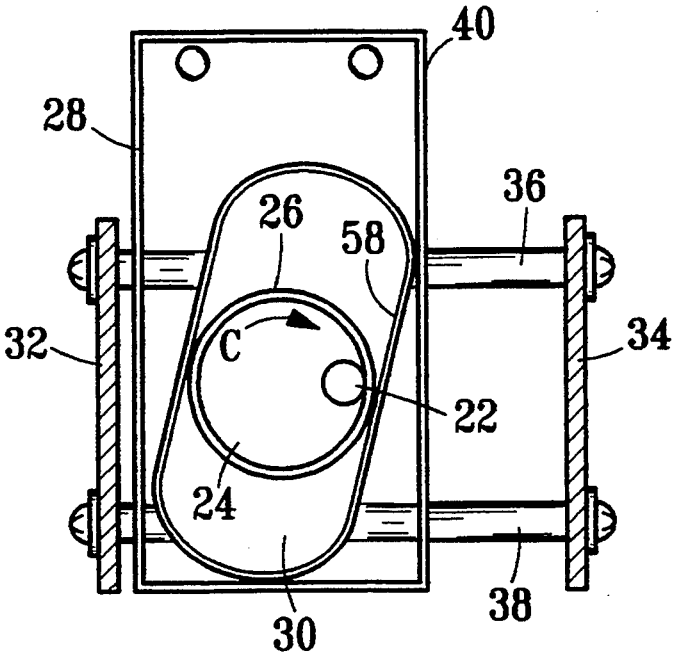
FIGS. 3A and 3B are sectional views showing the self-lubricating sliding member of the massage apparatus at a left dead point and a right dead point, respectively.
Figure 3B:
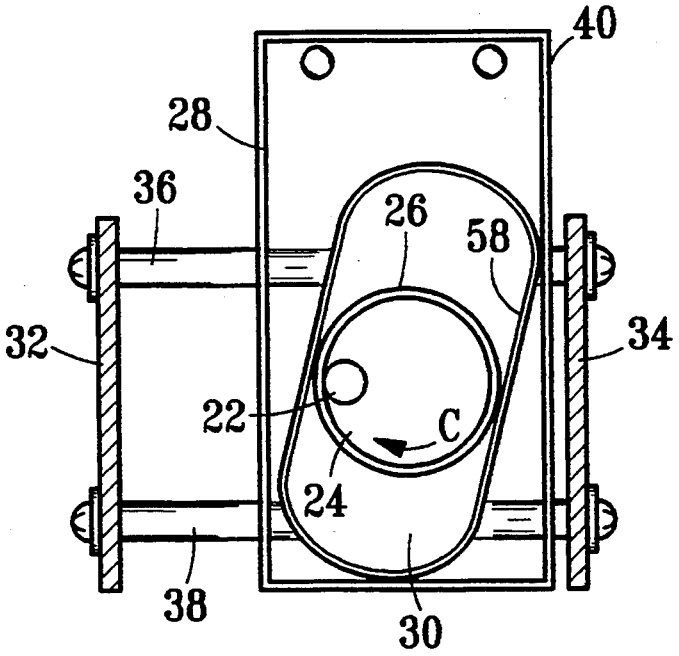
Figure 4A:
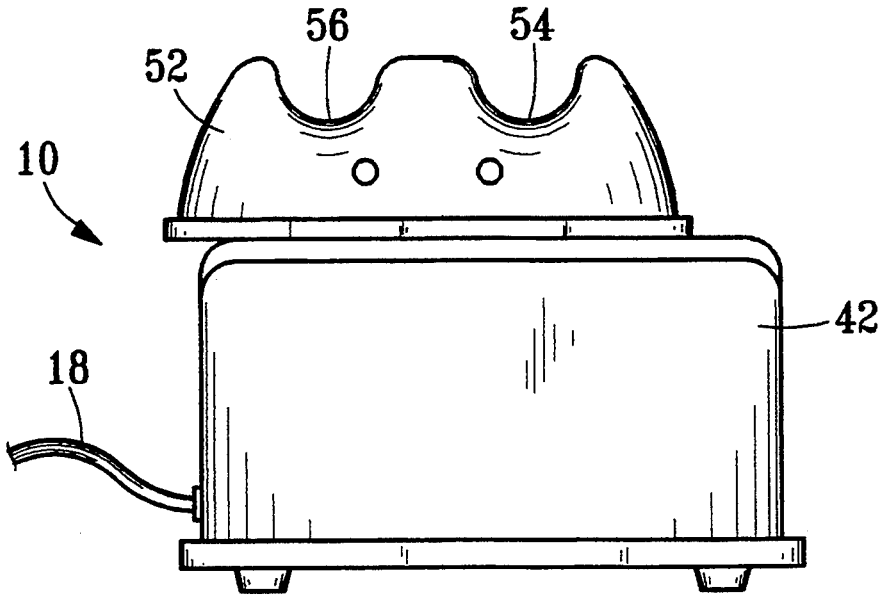
FIGS. 4A and 4B are elevation views showing the rest member of the massage apparatus at a left dead point and a right dead point, respectively.
Figure 4B:
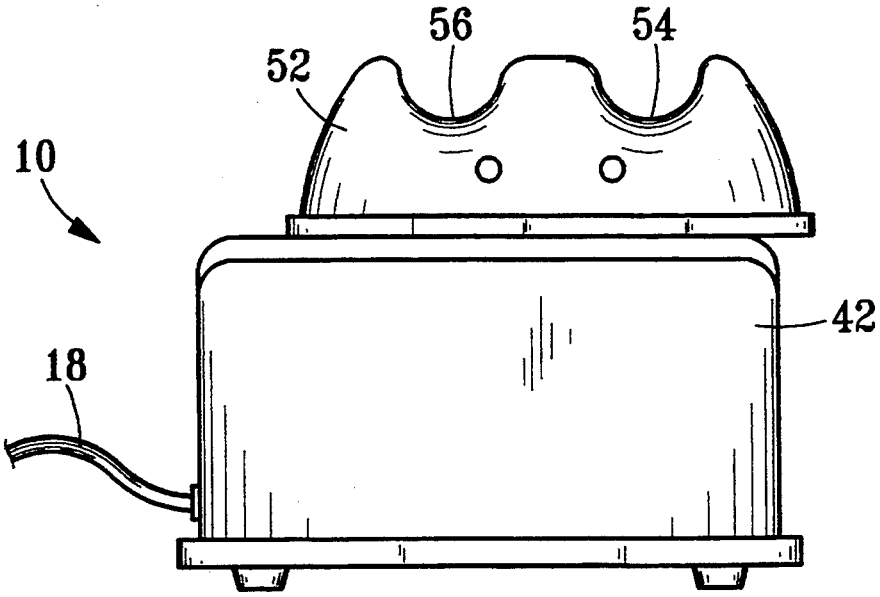

When the bearing 26 is moved by the driving shaft 22 to make eccentric rotational movement in the direction as shown by arrow C, a horizontal component applying on the circle of flange 58 defining the slant guide area 30 will push the sliding member 28 and the rest member 52 fixed to the top end of the sliding member 28 to do linear reciprocating movement along the shafts 36, 38. That is, the sliding member 28 and the rest member 52 may reciprocate in lateral directions between a left dead point as shown in FIGS. 3A and 4A, and a right dead point as shown in FIGS. 3B and 4B. By this lateral linear reciprocating movement, the massage apparatus according to the present invention provides a chiropractic and massage effect on the user's ankles or calves.

The major power transmission element adopted in the present invention is the wear-proof and self-lubricating sliding member 28, and the friction member adopted in the present invention is the bearing 26 which is also self-lubricating and of low-resistance. With their respective structural and physical properties, the sliding member 28 and the bearing 26 engages with each other in an almost clearance-free manner, and thereby, there is little or no frictional resistance existing between them. Meanwhile, any noise resulted from mutual friction of the components during their operation can be minimized. Furthermore, due to the low frictional resistance, the transmission efficiency of the electric motor 14 and its reducing gear set 16 can be effectively enhanced. The massage apparatus of the present invention, when compared with the conventional ones, is simplified in the structure, more practical in use, and economical in the production.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A reciprocating massage apparatus comprising:

a) a base;

b) a rest member for supporting a user's ankles or calves;

c) a sliding member fixedly connected to the rest member;

d) support means to slidably support the sliding member on the base such that the sliding member may undergo translational reciprocating movement along a linear path of travel with respect to the base;

e) a flange extending from the sliding member defining an enclosed guide area, the guide area having opposite, spaced apart, substantially parallel sides extending obliquely to the linear path of travel of the sliding member and curved opposite ends joining the opposite sides;

f) a rotatable driving shaft driven by a power source; and, g) a bearing eccentrically connected to the driving shaft so as to rotate therewith and located in the enclosed guide area, the bearing having a circular configuration with a diameter substantially equal to the distance between the spaced apart, parallel sides of the enclosed guide area and a radius substantially equal to the radii of the curved opposite ends of the enclosed guide area, such that rotation of the driving shaft and bearing causes translational, reciprocating movement of the sliding member along the linear path of travel.

2. The reciprocating massage apparatus of claim 1 wherein the sliding member is comprised of a self-lubricating material.

3. The reciprocating massage apparatus of claim 1 wherein the bearing is comprised of a self-lubricating material.

* * * * *